US006012647A

United States Patent [19]

Ruta et al.

[11] Patent Number: 6,012,647

[45] Date of Patent: Jan. 11, 2000

[54] APPARATUS AND METHOD OF ATOMIZING AND VAPORIZING

[75] Inventors: Constantin I. Ruta, White Bear Lake; Russell E. Blette, Hastings; Christopher S. Lyons, St. Paul; Robert J. Fleming, Lake Elmo, all of Minn.

[73] Assignee: 3M Innovative Properties Company, St. Paul, Minn.

[21] Appl. No.: 08/980,948

[22] Filed: Dec. 1, 1997

[51] Int. Cl.[7] ..... B05B 1/24; B05B 7/08

[52] U.S. Cl. ..... 239/132.1; 239/422; 239/424.5

[58] Field of Search ..... 239/132.1, 422, 239/424, 424.5

[56] References Cited

U.S. PATENT DOCUMENTS

| | | | |
|---|---|---|---|
| 1,829,661 | 10/1931 | Krautzberger . | |
| 2,460,861 | 2/1949 | Walters | 299/87 |
| 2,780,496 | 2/1957 | Asbeck et al. | 239/422 X |
| 2,827,330 | 3/1958 | Baur | 239/132.1 X |
| 2,864,653 | 12/1958 | Liedberg et al. | 239/422 X |
| 3,004,719 | 10/1961 | Pouppirt, Jr. | 239/424.5 X |
| 3,840,391 | 10/1974 | Spitz et al. | 117/106 R |
| 3,917,168 | 11/1975 | Tenney | 239/132.1 X |
| 4,076,866 | 2/1978 | Platakis et al. | 427/250 |
| 4,080,926 | 3/1978 | Platakis et al. | 118/5 |
| 4,179,068 | 12/1979 | Dombrowski | 239/13 |
| 4,290,384 | 9/1981 | Ausschnitt et al. | 118/722 |
| 4,392,617 | 7/1983 | Bakos et al. | 239/424.5 X |
| 4,582,731 | 4/1986 | Smith | 427/421 |
| 4,618,098 | 10/1986 | Hedger, Jr. et al. | 239/424.5 X |
| 4,682,565 | 7/1987 | Carrico . | |
| 4,696,719 | 9/1987 | Bischoff | 202/205 |
| 4,722,515 | 2/1988 | Ham | 261/142 |
| 4,734,227 | 3/1988 | Smith | 264/13 |
| 4,734,451 | 3/1988 | Smith | 524/493 |
| 4,771,946 | 9/1988 | Moy et al. | 239/112 |
| 4,842,893 | 6/1989 | Yializis et al. | 427/44 |
| 4,891,249 | 1/1990 | McIntyre et al. | 427/421 |
| 4,913,865 | 4/1990 | Toyotama | 264/81 |
| 4,927,079 | 5/1990 | Smith | 239/422 X |
| 4,954,371 | 9/1990 | Yializis | 427/44 |
| 5,018,048 | 5/1991 | Shaw et al. | 361/323 |
| 5,032,461 | 7/1991 | Shaw et al. | 428/461 |
| 5,097,800 | 3/1992 | Shaw et al. | 118/730 |
| 5,125,138 | 6/1992 | Shaw et al. | 29/25.42 |
| 5,190,592 | 3/1993 | Chazee | 118/719 |
| 5,204,314 | 4/1993 | Kirlin et al. | 505/1 |
| 5,229,171 | 7/1993 | Donovan et al. | 427/483 |
| 5,261,949 | 11/1993 | Schilling | 95/216 |
| 5,271,562 | 12/1993 | Myers et al. | 239/290 |
| 5,316,579 | 5/1994 | McMillan et al. | 118/50 |
| 5,375,766 | 12/1994 | Sweeney | 239/133 |
| 5,383,970 | 1/1995 | Asaba et al. | 118/726 |
| 5,421,895 | 6/1995 | Tsubouchi et al. | 118/726 |
| 5,427,317 | 6/1995 | Hüttlin | 239/422 |
| 5,431,736 | 7/1995 | Boer | 118/726 |
| 5,435,491 | 7/1995 | Sakuma | 239/424.5 X |
| 5,440,446 | 8/1995 | Shaw et al. | 361/301.5 |
| 5,478,014 | 12/1995 | Hynds | 239/135 |
| 5,526,981 | 6/1996 | Sanson | 239/8 |
| 5,536,323 | 7/1996 | Kirlin et al. | 118/726 |
| 5,536,531 | 7/1996 | Owen et al. | 427/256 |
| 5,540,772 | 7/1996 | McMillan et al. | 118/50 |
| 5,540,959 | 7/1996 | Wang | 427/561 |
| 5,547,708 | 8/1996 | Asaba et al. | 427/248.1 |
| 5,595,603 | 1/1997 | Klinedinst et al. | 118/715 |
| 5,653,813 | 8/1997 | Benzing et al. | 118/726 |
| 5,681,615 | 10/1997 | Affinito et al. | 427/255.6 |
| 5,882,416 | 3/1999 | Van Buskirk et al. | 118/726 |

FOREIGN PATENT DOCUMENTS

| | | |
|---|---|---|
| 0 509 367 A1 | 10/1992 | European Pat. Off. . |
| 0 715 898 A1 | 6/1996 | European Pat. Off. . |
| 494 922 | 9/1919 | France . |
| 910 454 | 6/1946 | France . |
| 2 450 124 | 9/1980 | France . |
| 40 08 466 | 6/1991 | Germany . |
| 161738 | 4/1921 | United Kingdom . |
| 1019396 | 2/1966 | United Kingdom . |
| WO 98/55668 | 12/1998 | WIPO . |

OTHER PUBLICATIONS

Harari, R. et al., "Optimization of a Plain–Jet Airblast Atomizer", *Atomization and Sprays*, vol. 7, 1997, pp. 71–113.

Lefebvre, A.H., *Atomization and Sprays*, Hemisphere Pub. Corp., 1989, pp. 2–14, 105–107, 112–128, 136–143, 146–149.

*Primary Examiner*—Lesley D. Morris
*Attorney, Agent, or Firm*—Douglas B. Little

[57] ABSTRACT

Apparatus suitable for atomizing and vaporizing at least a first liquid by colliding at least one gas with the first liquid. The apparatus includes a gas inlet through which the gas enters the apparatus and a first liquid inlet through which the first liquid enters the apparatus. A discharge end of the apparatus includes at least one first liquid discharge outlet through which at least one stream of the first liquid is discharged from the apparatus. The discharge end also includes at least one gas discharge outlet through which at least one stream of gas is discharged from the apparatus to collide with and thereby atomize the discharged stream of the first liquid. A first liquid passageway interconnects the first liquid inlet with the first liquid discharge outlet. A gas passageway interconnects the gas inlet with the at least one gas discharge outlet. In one embodiment, the gas passageway comprises at least one gas chamber in thermal contact with an initial portion of the first liquid passageway such that a heated quantity of the gas in the chamber preheats the first liquid in the initial portion of the first liquid passageway. In alternative embodiments, the gas passageway includes a pressure dampening chamber allowing gas to be continuously discharged without pulsating.

18 Claims, 8 Drawing Sheets

APPARATUS AND METHOD OF ATOMIZING AND VAPORIZING

FIELD OF THE INVENTION

This invention is in the field of devices, such as a nozzle, that are structured to cause two or more streams of material to collide in front of the devices. More specifically, this invention relates to devices and related methods in which a stream of a gas is caused to collide with a stream of a liquid in order to atomize the liquid.

BACKGROUND OF THE INVENTION

Atomization is a process in which a liquid composition is broken up into a mist of fine liquid droplets. Atomization is involved in a wide range of industrial applications, including humidification processes, coating operations in which the atomized liquid composition is caused to form a coating on a substrate, vaporization processes, materials transport processes, inhalation delivery processes, and the like.

Plain-jet, air blast atomization is an atomization technique in which a relatively high velocity gas stream is caused to collide with a stream of the liquid composition to be atomized. In a typical plain-jet, air blast atomization operation, streams of the gas and liquid composition are supplied to separate passageways of a plain-jet, air blast device, typically in the form of a nozzle. The gas stream is then shaped and discharged through an annularly shaped orifice of the apparatus as a converging, annularly shaped, high velocity stream. The liquid stream is discharged from an orifice located in approximately the center of the annularly-shaped gas orifice such that the discharged liquid stream is surrounded by the converging annulus of gas. Atomization results when the discharged gas stream convergingly collides with the discharged liquid stream in front of the apparatus.

Conventional plain-jet, air blast atomization devices tend to have a number of drawbacks. First, these devices tend to discharge the gas in a high frequency, pulsed fashion due to sonic vibrations that tend to develop in the gas stream. The energy of the gas/liquid collision thus varies with the frequency of the gas pulses. As a consequence, the atomized liquid droplets will have a size distribution that cyclically varies in accordance with the pulses as well. This size variation is a drawback in many operations, including coating operations in which the size variation of the droplets could result in nonuniform coating thicknesses. It would be desirable, therefore, to be able to generate a smooth, continuous, pulseless flow of gas so that the energy of collision, and hence the size and number density of the atomized droplets, would be more uniform.

Some of the currently known plain-jet, air blast devices also are not well-suited for handling sticky and/or relatively viscous liquids. These kinds of materials can plug or otherwise be difficult to convey in such devices. Yet, there are many applications, such as applying smooth coatings of adhesives onto a substrate, in which it would be desirable to be able to atomize such liquids in a smooth, continuous, reliable manner.

Slippage is another problem that affects plain-jet air blast devices. Slippage results because the gas/liquid collision does not break up the liquid composition into the final atomized state in the first instance. Instead, collision initially breaks the liquid into threads and ligaments that stretch and slenderize as the liquid is driven by the gas away from the apparatus. At some point, the stretched, slenderized bodies of liquid collapse and form the fully atomized liquid droplets. Thus, there is some time delay between the initial time of collision and the time that the final atomized state is reached. Accordingly, it would be desirable to carry out plain-jet, air blast atomization in a manner that minimizes slippage. For a discussion of slippage and principles of atomization in general, see, e.g., Lefebvre, A. H., *Atomization and Sprays,* Hemisphere Publishing Corp., U.S.A. (1989); and Harari et al., *Atomization and Sprays,* vol. 7, pp. 97–113 (1997).

DISCLOSURE OF INVENTION

The present invention provides a novel apparatus that causes a heated stream of gas to implosively and convergingly collide with at least one liquid stream in order to atomize and vaporize the liquid. Initially, the collision atomizes the liquid to form a mist of fine liquid droplets. The droplets, being in intimate contact with a relatively large volume of the gas, quickly vaporize with minimal slippage. Vaporization occurs quickly even at temperatures well below the boiling point of the liquid, because the partial pressure of the resultant vapor in the gas is well below the saturation pressure. Additionally, using implosive collision in this manner provides liquid droplets that have a smaller average droplet size with a narrower particle size distribution than atomized droplets obtained by using more conventional atomization devices. This capability is particularly beneficial in order to be able to quickly vaporize the droplets and then cause the resultant vapor to condense as a thin, substantially defect-free coating of uniform thickness upon any of a wide variety of substrates; although, in some cases discontinuous coatings can be intentionally made.

Generally, the inventive apparatus includes separate gas and liquid passageways by which the gas and liquid are conveyed through the apparatus. In one embodiment, the gas passageway includes a relatively large, preheating chamber that surrounds an initial portion of the liquid passageway. The enlarged preheating chamber provides numerous performance advantages. Firstly, gas conveyed through the preheating chamber preheats liquid in the initial portion of the liquid passageway. This reduces the viscosity of the liquid and makes it easier to convey the liquid through the apparatus. Additionally the preheated liquid is atomized much more rapidly upon collision with the gas with substantially no slippage, i.e., the combination of time delay and distortion of the liquid as it is converted from a stream to a fine mist of droplets.

As another advantage, the gas chamber acts like a pressure reservoir, or shock absorber, for dampening sonic vibrations of the gas as it is discharged from the apparatus. As a result, the flow of discharged gas is smooth, continuous, and pulseless as a practical matter. This, in turn, results in extremely uniform, consistent atomization (and vaporization if desired) of the liquid.

From the preheating chamber, the gas is acceleratingly conveyed to a pressure dampening chamber in which the gas flow shape is optimized, vibrations in the gas flow are dampened, and the gas flow pressure is equalized. From the dampening chamber, the gas is then conveyed to and through a suitable discharge outlet for collision with the liquid stream(s) to be atomized.

The apparatus of the present invention is also particularly suitable for atomizing relatively viscous, non-newtonian fluids that are not as easily atomized when using other atomization techniques. While not wishing to be bound by theory, a possible rationale to explain the benefits of the apparatus of the present invention in handling relatively viscous liquids can be offered. It is believed that the discharged, converging stream(s) of gas develop a partial vacuum in front of the apparatus that helps pull liquid through the apparatus after which the momentum of the gas helps convey the resultant atomized liquid droplets away from the apparatus. The pulling effect is enhanced by the reduced viscosity of the preheated liquid resulting from heat transfer to the liquid from the heated gas within the body of the apparatus. As an additional consequence of the partial vacuum, substantially no amount of liquid drools from the discharge face of the apparatus as would tend to be the case with other kinds of atomizing structures. In addition for handling viscous liquids in laminar flow, it is preferred that the liquid passageway (34 in FIG. 1*a*) is smooth and without discontinuities or abrupt changes in cross section along its length.

The principles of the present invention may be practiced in a reduced pressure environment, including a vacuum. Advantageously, however, atomization and vaporization, and coating can occur at any desired pressure, including ambient pressure. This avoids the need to rely upon costly vacuum chambers commonly used in previously known vapor coating processes. Furthermore, atomization and vaporization can occur at relatively low temperatures, even below ambient temperatures. This allows temperature sensitive materials to be atomized without degradation that might otherwise occur at higher temperatures. The present invention is also extremely versatile. Virtually any liquid material, or combination of liquid materials, can be handled.

In one aspect, the present invention relates to a apparatus suitable for atomizing and vaporizing at least a first liquid by colliding at least one gas with the first liquid. The apparatus includes a gas inlet through which the gas enters the apparatus and a first liquid inlet separate from the gas inlet through which the first liquid enters the apparatus. A discharge end of the apparatus includes at least one first liquid discharge outlet through which at least one stream of the first liquid is discharged from the apparatus. The discharge end also includes at least one gas discharge outlet through which at least one stream of gas is discharged from the apparatus to collide with and thereby atomize the discharged stream of the first. A first liquid passageway interconnects the first liquid inlet with the first liquid discharge outlet. A gas passageway is separate from the first liquid passageway and interconnects the gas inlet with the at least one gas discharge outlet. The gas passageway includes at least one preheating chamber in thermal contact with an initial portion of the first liquid passageway such that a quantity of the gas in the at least one chamber can preheat the first liquid in the initial portion of the first liquid passageway.

In another aspect, the present invention relates to another embodiment of an apparatus suitable for atomizing and vaporizing a plurality of liquids by colliding at least one gas with the liquids. The apparatus includes a gas inlet through which the gas enters the apparatus and a plurality of liquid inlets through which each liquid enters the apparatus. A discharge end includes a plurality of liquid discharge outlets through which corresponding streams of liquid are discharged from the apparatus and at least one gas discharge outlet through which at least one stream of gas is discharged from the apparatus to convergingly and implosively collide with and thereby atomize the streams of discharged liquid. A plurality of liquid passageways interconnect at least one of the liquid inlets with at least one corresponding liquid discharge outlet. A gas passageway interconnects the gas inlet with the at least one gas discharge outlet. The gas discharge outlet comprises at least one orifice surrounding the liquid discharge outlets.

In another aspect, the present invention relates to another embodiment of an apparatus suitable for atomizing and vaporizing at least a first liquid by colliding at least one gas with the first liquid. The apparatus comprises a gas inlet through which the gas enters the apparatus and a first liquid inlet through which the first liquid enters the apparatus. A discharge end includes at least one first liquid discharge outlet through which at least one stream of the first liquid is discharged from the apparatus and at least one gas discharge outlet through which at least one stream of gas is discharged from the apparatus to collide with and thereby atomize the discharged stream of the first liquid. A first liquid passageway interconnects the first liquid inlet with the first liquid discharge outlet and a gas passageway interconnects the gas inlet with the at least one gas discharge outlet. The gas passageway includes a pressure dampening chamber comprising at least one gas inlet port and at least one gas outlet port, wherein the at least one gas inlet port is radially offset from the at least one gas outlet port.

In another aspect, the present invention relates to a method of atomizing at least one liquid through a collision with a heated gas. A flow of the heated gas is caused to preheat at least one separate flow of the liquid. The flow of heated gas is then accelerated and shaped into at least one converging heated gas stream that convergingly surrounds the preheated liquid flow. The converging heated gas stream is caused to convergingly and implosively collide with the preheated liquid stream. The liquid stream is atomized as a result.

BRIEF DESCRIPTION OF THE DRAWINGS

FIG. 5*c* is a side view, shown in cross section, of the assembled apparatus of FIG. 5*a.

DETAILED DESCRIPTION OF THE PRESENTLY PREFERRED EMBODIMENTS

Figure 1A:
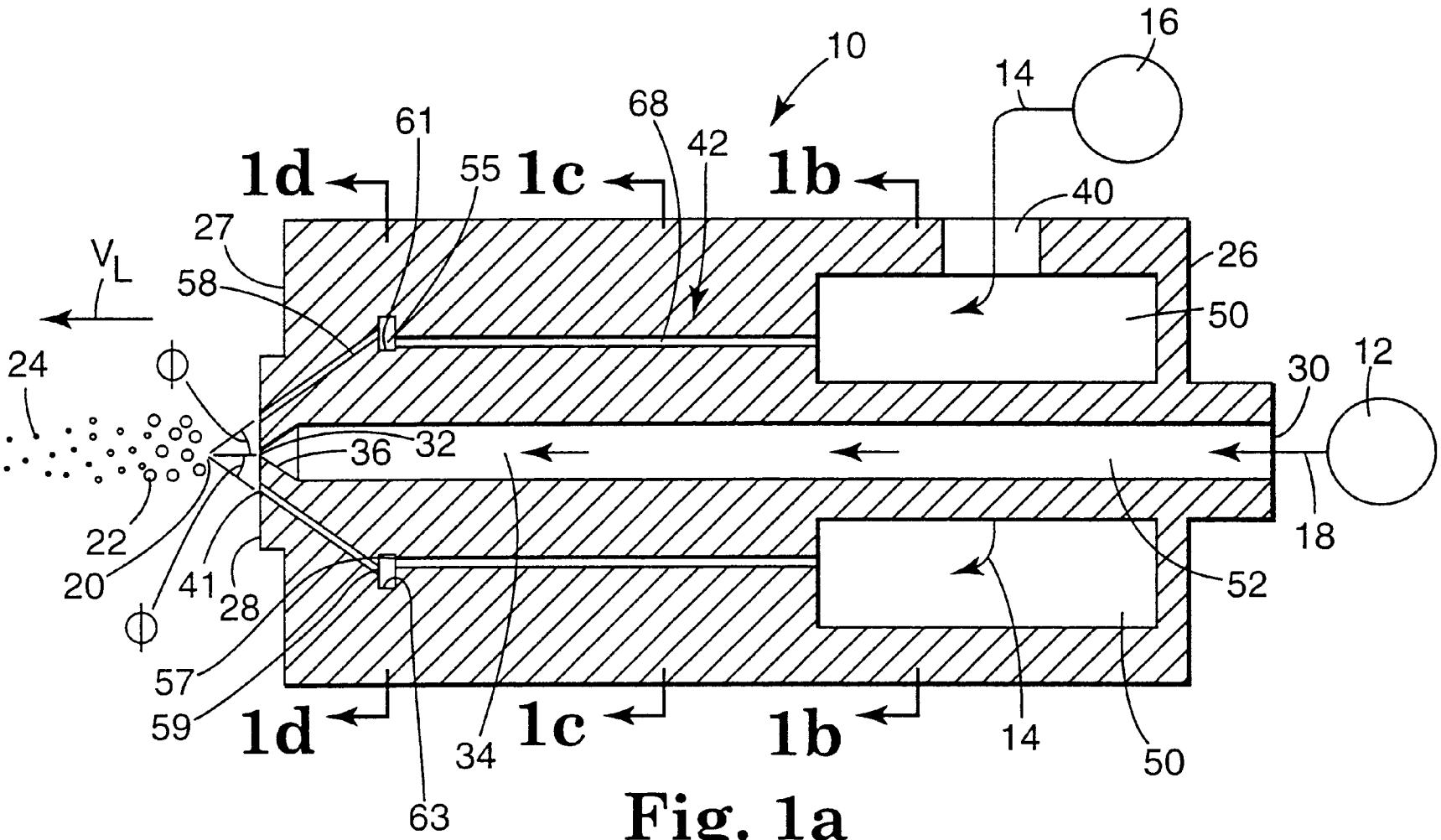
FIG. 1*a* schematically shows a side view of one embodiment of a apparatus of the present invention in cross section.
Figure 1B:
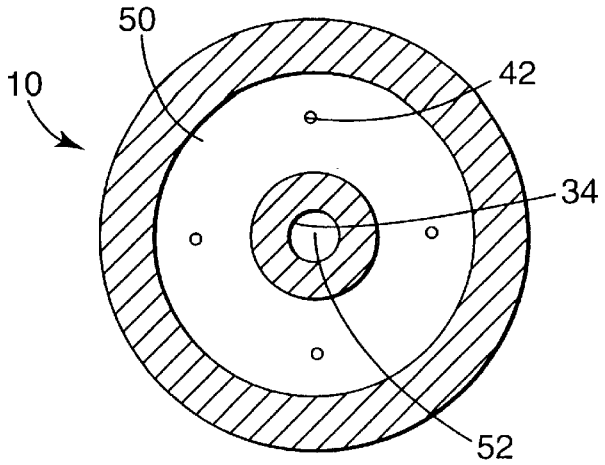
FIG. 1*b* is a cross section of FIG. 1*a* taken across line 1*b*—1*b;*
Figure 1C:
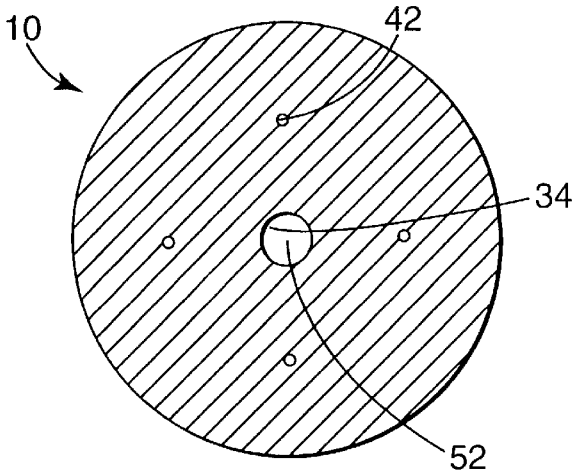
FIG. 1*c* is a cross section of the apparatus of FIG. 1*a* taken across line 1*c*—1*c;*

The embodiments of the present invention described below are not intended to be exhaustive or to limit the invention to the precise forms disclosed in the following detailed description. Rather the embodiments are chosen and described so that others skilled in the art may appreciate and understand the principles and practices of the present invention.

FIGS. 1*a*, 1*b*, 1*c* and 2 schematically show one representation of a preferred apparatus 10 of the present invention suitable for atomizing and vaporizing a liquid composition. Generally, apparatus 10 is structured to cause stream 14 of gas 16 to convergingly and implosively collide with stream 18 of liquid composition 12 at collision site 20 in front of apparatus 10. The implosive energy of the collision atomizes stream 18 of liquid composition 12 to form a plurality of atomized liquid droplets 22. Preferably, liquid droplets 22 have an average droplet size of less than 200 micrometers, preferably 10 to 100 micrometers, more preferably 10 to 30 micrometers. For purposes of clarity, a collision involving only one liquid stream 18 and one gas stream 14 is shown. Alternatively, a plurality of liquid streams could be used if desired.

Following atomization, liquid droplets 22 quickly vaporize and become dispersed in gas 16 as a non-light-scattering vapor phase schematically depicted as vapor 24. Vapor 24 preferably is a true vapor, but also might be a dispersed phase in which dispersed droplets are too small, e.g., being of an average size of less than about 30 nm, to scatter visible and/or laser light having a wavelength of 630 nm to 670 nm. Thus, although FIG. 1*a* shows vapor 24 schematically as a plurality of droplets, in actuality, vapor 24 is not visible. In fact, the visual disappearance of liquid droplets 22 following the collision of streams 14 and 18 indicates that the collision was carried out under conditions effective to vaporize substantially all of liquid composition 12.

Referring to the structure of apparatus 10 now in more detail, apparatus 10 has inlet end 26 and discharge end 27 including discharge face 28. Proximal to inlet end 26, liquid composition 12 enters apparatus 10 through liquid inlet 30, and a stream 18 of liquid composition 12 is discharged from apparatus 10 through liquid discharge outlet 32. Liquid passageway 34 interconnects liquid inlet 30 and liquid discharge outlet 32 and provides a conduit for transporting and accelerating liquid composition 12 through apparatus 10.

Figure 2:
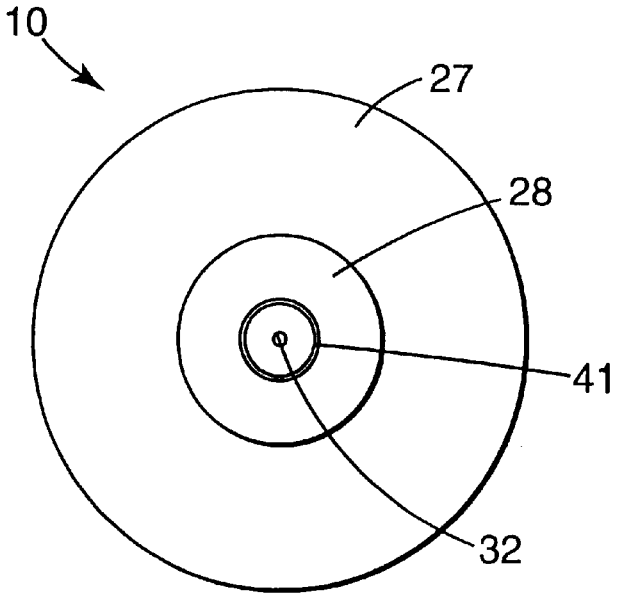
FIG. 2 is an end view of the apparatus of FIG. 1*a;*
Figure 3:
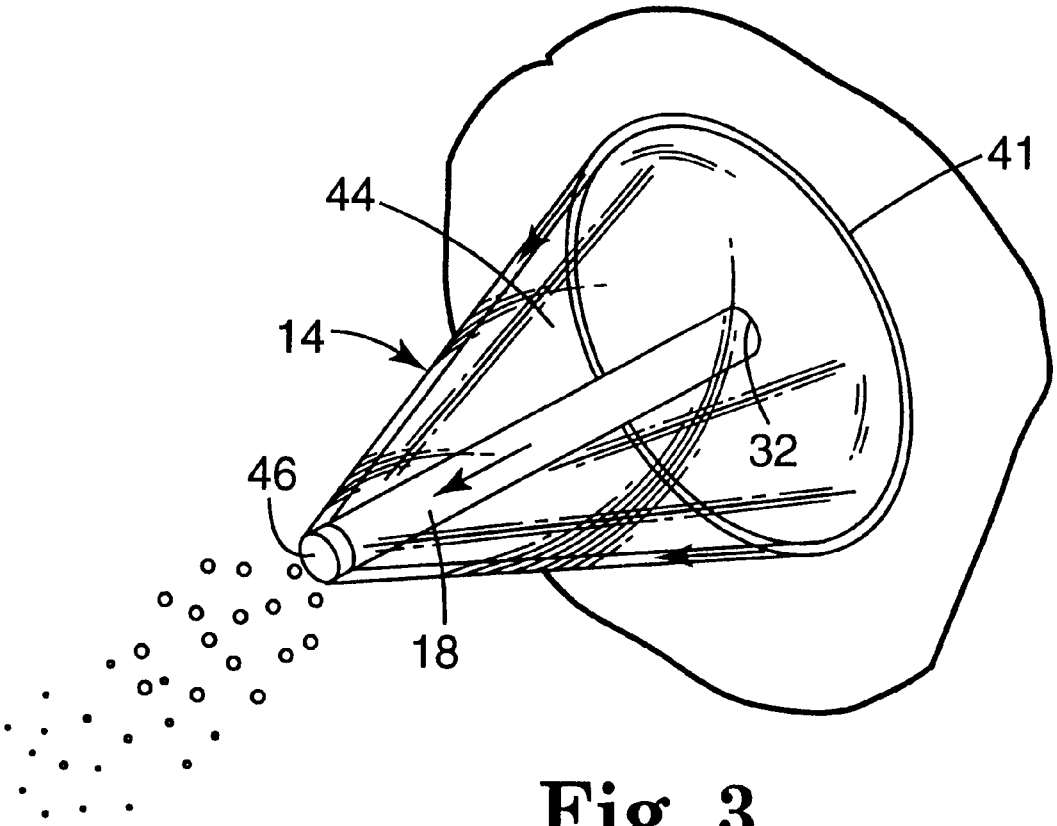
FIG. 3 is a perspective view, with parts broken away for purposes of illustration, of the liquid and gas streams discharged by the apparatus of FIG. 1*a;*

Stream 14 of gas 16 enters apparatus 10 through gas inlet 40, and is discharged from apparatus 10 through gas outlet 41. Generally, gas outlet 41 may comprise one or more orifices through which gas stream 14 is shaped so that the discharged gas stream(s) convergingly surround and implosively collide with discharged liquid stream 18. A variety of structures for gas discharge outlet 41 may be used for this purpose. As best shown in FIG. 2, gas outlet 41 preferably is annularly-shaped in order to discharge a converging, annularly-shaped stream of gas that substantially completely surrounds discharged liquid stream 18 up to collision site 20. FIG. 3, illustrates the geometry of colliding gas and liquid streams 14 and 18 generated by using apparatus 10 configured with annularly-shaped discharge outlet 41. Converging, annularly-shaped stream 14 of gas 16, having interior region 44, emerges from annularly-shaped gas outlet 41 of apparatus 10 and converges towards apex 46. Liquid discharge outlet 32, located in approximately the center of annular gas outlet 41, ejects stream 18 of liquid composition 12 through interior region 44 and towards apex 46, where converging frustoconical gas stream 14 implosively collides with liquid stream 18. Liquid stream 18 is thereby atomized with great force.

As used herein, the term "implosively" with respect to the collision of one or more gas streams and liquid streams means that one or more streams of gas collide with substantially the same cross-sectional portion of a liquid stream simultaneously from two or more different directions around the periphery of the liquid stream portion. More preferably, as would be the case when the gas stream has a converging, annular shape as shown in FIG. 3, implosive collision occurs around substantially the entire periphery of the liquid stream portion.

Figure 4:
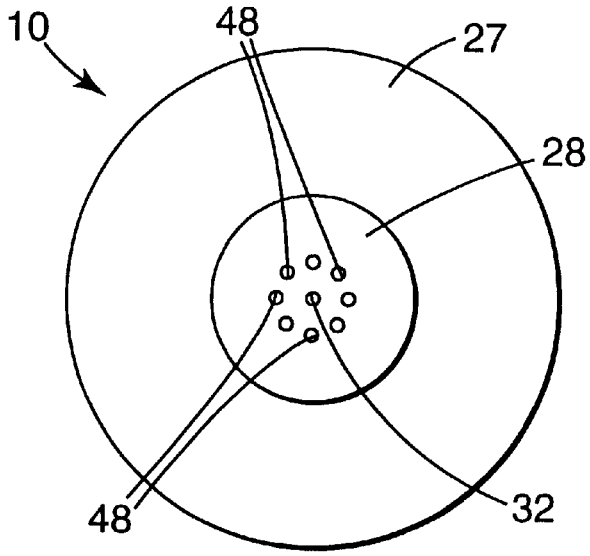
FIG. 4 is an alternative embodiment of an apparatus similar to the apparatus of FIG. 1*a* except that a plurality of gas discharge orifices are used instead of a single, annularly-shaped gas outlet.

As an alternative, other outlet structures capable of causing a gas to implosively collide with a liquid may be used for gas outlet 41, if desired. For example, as shown in FIG. 4, gas outlet 41 may comprise a plurality of orifices 48 surrounding liquid discharge outlet 32. In use, corresponding converging gas streams would be discharged from orifices 48. The gas streams would convergingly and implosively collide with the liquid stream discharged through liquid discharge outlet 32. As was the case with FIG. 2 and 3, the liquid stream thereby would be atomized with great force. For purposes of illustration, eight orifices 48 are shown in FIG. 4. However, a greater or lesser number of orifices 48 may be used. For example, using from two to about 50 of such orifices would be suitable in the practice of the present invention.

Gas passageway 42 fluidly interconnects gas inlet 40 with gas outlet 41. Gas passageway 42 and liquid passageway 34 preferably are separate from each other such that gas 16 and liquid composition 12 are not mixed together until after streams 14 and 18 are discharged and caused to collide in front of apparatus 10. Gas passageway 42 comprises at least one enlarged chamber 50 in thermal contact with an initial portion 52 of liquid passageway 34. As perhaps best shown in FIG. 1*b*, chamber 50 preferably is annularly-shaped and completely surrounds initial portion 52 of liquid passageway 34. Chamber 50 provides numerous performance advantages. Firstly, because chamber 50 is in thermal contact with initial portion 52 of liquid passageway 34, a heated quantity of gas 16 in chamber 50 preheats a quantity of liquid composition 12 in initial portion 52. As a result of preheating, the preheated liquid is more easily atomized and vaporized upon implosive collision with gas 16. In contrast, if the liquid is not preheated, bigger droplets 22 tend to form that do not vaporize as quickly. As another advantage, chamber 50 is sufficiently large in volume so as to help reduce sonic vibrations of gas 16 discharged from apparatus 10.

The surface area of the common wall between chamber 50 and liquid passageway 34 preferably is large enough to allow efficient heat transfer from gas 16 to liquid composition 12. If the surface area is too small, insufficient thermal energy may be transferred, making it more difficult to achieve atomization. On the other hand, the surface area may be as large as desired, subject to practical limitations beyond which little additional thermal benefits would be observed. In terms of volume, a larger chamber 50 permits more gas 16 at higher pressure to be present, thus providing more heat energy to be available for thermal transfer to liquid composition 12. The volume may be as large as desired subject to practical limitations as noted above.

Figure 1D:
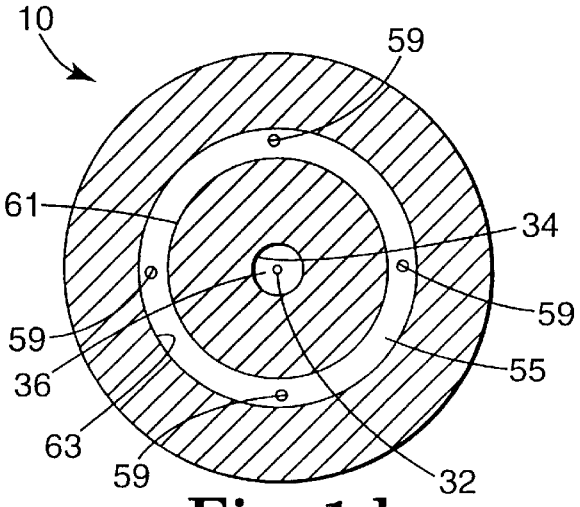
FIG. 1*d* is a cross section of the apparatus of FIG. 1*a* taken across line 1*d*—1*d;*

Downstream from chamber 50, gas passageway 42 includes pressure dampening chamber 55. As best seen in FIG. 1*d*, pressure dampening chamber 55 is annularly-shaped and surrounds liquid passageway 34. Gas enters chamber 55 through entry ports 57 via plurality of constricted passages 68 that acceleratingly convey from chamber 50. Gas leaves chamber 55 through exit ports 59. Entry ports 57 are proximal to inner periphery 61 of chamber 55, and exit ports 59 are proximal to outer periphery 63 of chamber 55. Thus, entry ports 57 and exit ports 59 are radially offset from each other. Advantageously, chamber 55 reshapes gas flowing from passages 68, dampens sonic vibrations in gas 16, and equalizes the pressure of gas 16 for more uniform discharge characteristics. In practical effect, chamber 55 acts like a "shock absorber" to help ensure that stream 14 of discharged gas 16 is ejected from apparatus 10 as a substantially continuous, pulseless flow. In the absence of chamber 55, gas 16 might tend to be ejected from apparatus 10 in a pulsed fashion, leading to nonuniform atomization of liquid stream 18.

From chamber 50, gas 16 is conveyed downstream toward chamber 55. Gas passageway 42 includes annularly-shaped, converging discharge chute 58 proximal to gas discharge outlet 41. Discharge chute 58 helps to shape gas stream 14 as it is discharged from apparatus 10 as a converging, annularly-shaped flow of gas. Discharge chute 58 also has a cross-sectional area effective to discharge gas 16 at the desired discharge velocity.

Alternatively, chute 58 may be a plurality of holes arranged, sized and oriented to yield a number of balanced streams which converge in a cone. Preferably the number of holes is at least 6, more preferably at least 12.

In operation, heated stream 14 of gas 16 enters apparatus 10 through gas inlet 40 and enters annularly shaped, enlarged chamber 50. In a typical atomization/vaporization operation, gas stream 14 is supplied at a pressure in the range from 15 psi (104 kPa) to 100 psi (690 kPa), preferably 15 psi (104 kPa) to 45 psi (310 kPa). The quantity of gas 16 in chamber 50 is in thermal contact with and preheats the quantity of liquid composition 12 in the initial portion 52 of liquid passageway 34 surrounded by chamber 50. The preheated liquid will have a reduced viscosity and will thereby be easier to be conveyed through liquid passageway 34 of apparatus 10, then to be ejected through liquid discharge outlet 32, and thereafter to be atomized upon collision with gas stream 14. As liquid stream 18 is conveyed through the tapered portion 36 of liquid passageway 34, the velocity of liquid stream 18 is increased prior to being discharged.

From annular chamber 50, gas stream 14 flows through constricted a passageway 68 in which the flow rate of gas stream 14 is accelerated. The accelerated gas stream 14 then flows into chamber 55 and then through discharge chute 58 where gas stream 14 is shaped into a converging, annularly-shaped flow of gas that is discharged from gas outlet 41. The discharged gas stream 14 convergingly surrounds discharged liquid stream 18. The converging gas stream 14 then convergingly and implosively collides with liquid stream 18, whereby liquid stream 18 is atomized and vaporized.

The collision between streams 14 and 18 may occur under a wide range of operating conditions under which a substantial portion, preferably substantially all, and more preferably all of liquid stream 18 is atomized and then vaporized as a result of the collision. Factors that might have a tendency to affect atomization and vaporization performance include the temperature of the gas, the temperature of the liquid, the angle at which streams 14 and 18 collide, the velocities of streams 14 and 18 at the time of collision, the flow rates of gas 16 and liquid composition 12, the nature of liquid composition 12, the nature of the gas 16, and the like.

For instance, in embodiments of the present invention in which it is desired to atomize and vaporize liquid composition 12, enough gas 16 is supplied at a temperature above the condensation temperature of vapor 24, but below the boiling point of the fluid components that are to be vaporized. Higher temperatures, e.g., temperatures at or above the boiling point of the fluid components, are not needed to achieve and maintain vaporization because contact between gas 16 and liquid composition 12 is carried out under conditions such that the partial pressure of vapor 24 is below the vapor saturation pressure. This thermal-physical-mechanical ability to vaporize components without resorting to higher temperatures is particularly advantageous when using a liquid composition 12 including one or more components that might be damaged or otherwise degraded at high temperatures.

If the components of liquid composition 12 would not be harmed by high temperatures, gas 16 could be supplied at temperatures above the boiling point(s) of the fluid component(s). In fact, the use of such higher temperatures may be beneficial in some applications. For example, because the thermal energy for vaporization comes from gas 16, higher gas temperatures may be needed and/or desirable in order to supply enough thermal energy to vaporize some liquids, particularly at higher flow rates of the liquids. In such instances, the resultant admixture of gas 16 and vapor 24 may end up having a temperature above or below the boiling point(s) of one or more of the vapor components, depending upon factors such as the initial temperature of the gas 16, the initial temperature of liquid composition 12, and the relative flow rates of the two materials.

The flowrate of gas 16 typically is greater than that of liquid composition 12 to ensure that all of the liquid composition 12 can vaporize without gas 16 becoming saturated with vapor. In a typical atomizing and vaporizing operation, liquid composition 12 may be supplied at a flowrate in the range of 0.01 ml/min to 15 ml/min, and gas 16 may be supplied at a flowrate of 4 l/min to 400 l/min at standard temperature and pressure. The ratio of the gas flowrate (in terms of liters per minute) to the liquid composition flowrate (also in terms of liters per minute) is typically at least 20:1, preferably in the range from $10^3$:1 to $10^6$:1.

Streams 14 and 18 may be caused to collide at an angle $\Phi$ within a broad range with beneficial results. For instance, referring primarily to FIG. 1*a*, stream 14 may be ejected towards liquid stream 18 at an angle $\Phi$ preferably in the range from about 15° to 70°, more preferably, about 30° to 60°, most preferably 43° to 47°. In particular, streams 14 and 18 collided at an angle $\Phi$ in the preferred range from 15° to 70° have a lateral component of velocity, designated by the arrow $V_L$, that helps motivate the resultant liquid droplets 22, vapor 24, and gas 16 outward away from apparatus 10 following collision.

Choosing appropriate velocities for each of discharged streams 14 and 18 requires a balancing of competing concerns. For example, if the velocity of liquid stream 18 is too low at the time of collision, stream 18 may not have enough momentum to reach collision site 20. On the other hand, too high a velocity may make it more difficult to eject liquid stream 18 from apparatus 10 under laminar flow conditions. Maintaining laminar flow conditions is particularly preferred when liquid composition 12 is a non-newtonian fluid. If the velocity of gas stream 14 were too low, the average size of droplets 22 may be too large to be vaporized efficiently or to form coating 12 of the desired uniformity. On the other hand, the velocity of gas stream 14 may be as high as is desired. Indeed, higher gas velocities are better for atomizing and vaporizing more viscous liquid compositions. However, above a certain gas velocity, too little extra performance benefit may be observed to justify the additional incremental efforts needed to achieve such higher velocity. Balancing these concerns, stream 20 preferably has a velocity of 0.1 meters per second (m/s) to 30 m/s, more preferably 1 m/s to 20 m/s, most preferably about 10 m/s, and carrier gas stream 22 preferably has a velocity of 40 to 350 m/s, more preferably about 60 to 300 m/s, most preferably about 180 to 200 m/s.

Still referring to FIGS. 1*a*, 1*b*, 1*c*, and 2, apparatus 10 is very versatile and can be used to form coatings from an extremely broad range of liquid compositions 12. Liquid compositions may be used that are effective for forming adhesive coatings, primer coatings, decorative coatings, protective hard coatings, varnish coatings, antireflective coatings, reflective coatings, interference coatings, release coatings, dielectric coatings, photoresist coatings, conductive coatings, nonlinear optic coatings, electrochromic/electroluminescent coatings, barrier coatings, biologically-active coatings, biologically inert coatings, and the like.

Preferably, liquid composition 12 comprises at least one fluid component having a vapor pressure sufficiently high to be vaporized as a result of contact with gas 16 at a temperature below the boiling point of the composition. More preferably, all fluid components of liquid composition 12 have such a vapor pressure. Generally, a fluid component has a sufficiently high vapor pressure for this purpose if substantially all of the fluid component can vaporize into admixture with gas 16 and yet still have a resultant partial pressure in the resultant gaseous admixture that is below the saturation vapor pressure for that component. In typical operations, preferred fluid components have a vapor pressure in the range of 0.13 mPa to 13 kPa ($1\times10^{-6}$ Torr to 100 Torr) at standard temperature and pressure.

Liquid composition 12 may be organic, inorganic, aqueous, a nonaqueous, or the like. In terms of phase characteristics, liquid composition 12 may be homogeneous or a multiphase mixture of components and may be in the form of a solution, a slurry, a multiphase fluid composition, or the like. To form polymeric coatings, liquid composition 12 may include one or more components that are monomeric, oligomeric, or polymeric, although typically only relatively low molecular weight polymers, e.g., polymers having a number average molecular weight of less than 10,000, preferably less than about 7500, and more preferably less than about 4500, would have sufficient vapor pressure to be vaporized in the practice of the present invention. As used herein, the term "monomer" refers to a single, one unit molecule capable of combination with itself or other monomers to form oligomers or polymers. The term "oligomer" refers to a compound that is a combination of 2 to 10 monomers. The term "polymer" refers to a compound that is a combination of 11 or more monomers.

Representative examples of the at least one fluid component would include chemical species such as water; organic solvents, inorganic liquids, radiation curable monomers and oligomers having carbon-carbon double bond functionality (of which alkenes, (meth)acrylates, (meth)acrylamides, styrenes, and allylether materials are representative), fluoropolyether monomers, oligomers, and polymers, fluorinated (meth)acrylates, waxes, silicones, silane coupling agents, disilazanes, alcohols, epoxies, isocyanates, carboxylic acids, carboxylic acid derivatives, esters of carboxylic acid and an alcohol, anhydrides of carboxylic acids, aromatic compounds, aromatic halides, phenols, phenyl ethers, quinones, polycyclic aromatic compounds, nonaromatic heterocycles, azlactones, furan, pyrrole, thiophene, azoles, pyridine, aniline, quinoline, isoquinoline, diazines, pyrones, pyrylium salts, terpenes, steroids, alkaloids, amines, carbamates, ureas, azides, diazo compounds, diazonium salts, thiols, sulfides, sulfate esters, anhydrides, alkanes, alkyl halides, ethers, alkenes, alkynes, aldehydes, ketones, organometallic species, titanates, zirconates, aluminates, sulfonic acids, phosphines, phosphonium salts, phosphates, phosphonate esters, sulfur-stabilized carbanions, phosphorous stabilized carbanions, carbohydrates, amino acids, peptides, reaction products derived from these materials that are fluids having the requisite vapor pressure or can be converted (e.g., melted, dissolved, or the like) into a fluid having the requisite vapor pressure, combinations of these, and the like. Of these materials, any that are solids under ambient conditions, such as a paraffin wax, can be melted, or dissolved in another fluid component, in order to be processed using the principles of the present invention.

In some embodiments of the invention, the fluid component(s) to be included in liquid composition 12 is/are capable of condensing from the vapor state and then solidifying due in substantial part to a phase change resulting from cooling such component(s) to ambient temperature. For example, a wax vapor typically will condense as a liquid, but then will solidify as the temperature of the wax is cooled to a temperature below the melting point of the wax. Examples of other useful materials that have this phase change behavior include polycyclic aromatic compounds such as naphthalene.

In other embodiments of the invention, liquid composition 12 may comprise one or more different fluid components that are capable of reacting with each other to form a reaction product derived from reactants comprising such components. These components may be monomeric, oligomeric, and/or low molecular weight polymers (collectively referred to herein as "polymeric precursors") so that the reaction between the components yields a polymeric product. For example, liquid composition 12 may include a polyol component such as a diol and/or a triol, a polyisocyanate such as a diisocyanate and/or a triisocyanate, and optionally a suitable catalyst.

As another example of an approach using polymeric precursors, liquid composition 12 may comprise one or more organofunctional silane or titanate monomers. Such organofunctional silane and titanate monomers generally are capable of crosslinking upon drying and heating to form a polymeric siloxane-type matrix. A wide variety of organofanctional silane monomers may be used in the practice of the present invention. Representative examples include methyl trimethoxysilane, methyl triethoxysilane, phenyl trimethoxysilane, phenyl triethoxysilane, (meth) acryloxyallyl trimethoxysilane, isocyanatopropyltriethoxysilane, mercaptopropyltriethoxysilane, (meth)acryloxyallyl trichlorosilane, phenyl trichlorosilane, vinyl trimethoxysilane, vinyl triethoxysilane, propyl trimethoxysilane, propyl triethoxysilane, glycidoxyalkyl trimethoxysilane, glycidoxyalkyl triethoxysilane, glycidoxyallyl trichlorosilane, perfluoro alkyl trialkoxysilane, perfluoromethyl alkyl trialkoxysilane, perfluoroalkyl trichlorosilane, perfluorooctylsulfonamidopropylmethoxysilane, titanium isopropoxide, isopropyldimethacry(isostearoyltitanate), isopropyltri(N-ethylenediamine) ethyltitanate, combinations of these, and the like.

In still other embodiments of the present invention, liquid composition 12 may comprise at least one polymeric precursor component comprising radiation crosslinkable functionality such that the condensed material is curable upon exposure to radiant curing energy in order to cure and solidify (i.e. polymerize and/or crosslink) the material. Representative examples of radiant curing energy include electromagnetic energy (e.g., infrared energy, microwave energy, visible light, ultraviolet light, and the like), accelerated particles (e.g., electron beam energy), and/or energy from electrical discharges (e.g., coronas, plasmas, glow discharge, or silent discharge).

In the practice of the present invention, radiation crosslinkable functionality refers to functional groups directly or indirectly pendant from a monomer, oligomer, or polymer backbone (as the case may be) that participate in crosslinking and/or polymerization reactions upon exposure to a suitable source of radiant curing energy. Such functionality generally includes not only groups that crosslink via a cationic mechanism upon radiation exposure but also groups that crosslink via a free radical mechanism. Representative examples of radiation crosslinkable groups suitable in the practice of the present invention include epoxy groups, (meth)acrylate groups, olefinic carbon-carbon double bonds, allylether groups, styrene groups, (meth)acrylamide groups, combinations of these, and the like.

Preferred free-radically curable monomers, oligomers, and/or polymers each include one or more free-radically polymerizable, carbon-carbon double bonds such that the average functionality of such materials is at least one free-radically carbon-carbon double bond per molecule. Materials having such moieties are capable of copolymerization and/or crosslinking with each other via such carbon-carbon double bond functionality. Free-radically curable monomers suitable in the practice of the present invention are preferably selected from one or more mono, di, tri, and tetrafunctional, free-radically curable monomers. Various amounts of the mono, di, tri, and tetrafunctional, free-radically curable monomers may be incorporated into the present invention, depending upon the desired properties of the final coating. For example, in order to provide coatings with higher levels of abrasion and impact resistance, it is desirable for the composition to include one or more multifunctional free-radically curable monomers, preferably at least both di and tri functional free-radically curable monomers, such that the free-radically curable monomers incorporated into the composition have an average free-radically curable functionality per molecule of greater than 1.

Preferred compositions of the present invention may include 1 to 100 parts by weight of monofunctional free-radically curable monomers, 0 to 75 parts by weight of difunctional free-radically curable monomers, 0 to 75 parts by weight of trifunctional free-radically curable monomers, and 0 to 75 parts by weight of tetrafunctional free-radically curable monomers, subject to the proviso that the free-radically curable monomers have an average functionality of 1 or greater, preferably 1.1 to 4, more preferably 1.5 to 3.

One representative class of monofunctional free-radically curable monomers suitable in the practice of the present invention includes compounds in which a carbon-carbon double bond is directly or indirectly linked to an aromatic ring. Examples of such compounds include styrene, allylated styrene, alkoxy styrene, halogenated styrenes, free-radically curable naphthalene, vinylnaphthalene, alkylated vinyl naphthalene, alkoxy vinyl naphthalene, combinations of these, and the like. Another representative class of monofunctional, free radially curable monomers includes compounds in which a carbon-carbon double bond is attached to an cycloaliphatic, heterocyclic, and/or aliphatic moiety such as 5-vinyl-2-norbornene, 4-vinyl pyridine, 2-vinyl pyridine, 1-vinyl-2-pyrrolidinone, 1-vinyl caprolactam, 1-vinylimidazole, N-vinyl formamide, and the like.

Another representative class of such monofunctional free-radically curable monomers include (meth)acrylate functional monomers that incorporate moieties of the formula:

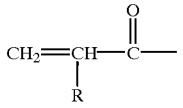

wherein R is a monovalent moiety, such as hydrogen, halogen, methyl, or the like. Representative examples of monomers incorporating such moieties include (meth) acrylamides, chloro(meth)acrylamide, linear, branched, or cycloaliphatic esters of (meth)acrylic acid containing from 1 to 10, preferably 1–8, carbon atoms, such as methyl (meth) acrylate, n-butyl (meth)acrylate, t-butyl (meth)acrylate, ethyl (meth)acrylate, isopropyl (meth)acrylate, 2-ethylhexyl (meth)acrylate, and isooctylacrylate; vinyl esters of alkanoic acids wherein the alkyl moiety of the alkanoic acids contain 2 to 10, preferably 2 to 4, carbon atoms and may be linear, branched, or cyclic; isobornyl (meth)acrylate; vinyl acetate; allyl (meth)acrylate, and the like.

Such (meth)acrylate functional monomers may also include other kinds of functionality such as hydroxyl functionality, nitrile functionality, epoxy functionality, carboxylic functionality, thiol functionality, amine functionality, isocyanate functionality, sulfonyl functionality, perfluoro functionality, sulfonamido functionality, phenyl functionality, combinations of these, and the like. Representative examples of such free-radically curable compounds include glycidyl (meth)acrylate, (meth) acrylonitrile, β-cyanoethyl-(meth)acrylate, 2-cyanoethoxyethyl (meth)acrylate, p-cyanostyrene, p-(cyanomethyl)styrene, an ester of an α,β-unsaturated carboxylic acid with a diol, e.g., 2-hydroxyethyl (meth) acrylate, or 2-hydroxypropyl (meth)acrylate; 1,3-dihydroxypropyl-2-(meth)acrylate; 2,3-dihydroxypropyl-1-(meth)acrylate; an adduct of an α,β-unsaturated carboxylic acid with caprolactone; an alkanol vinyl ether such as 2-hydroxyethyl vinyl ether; 4-vinylbenzyl alcohol; allyl alcohol; p-methylol styrene, N,N-dimethylamino (meth) acrylate, (meth)acrylic acid, maleic acid, maleic anhydride, trifluoroethyl (meth)acrylate, tetrafluoropropyl (meth) acrylate, hexafluorobutyl (meth)acrylate, butylperfluorooctylsulfonamidoethyl (meth)acrylate, ethylperfluorooctylsulfonamidoethyl (meth)acrylate, mixtures thereof, and the like.

Another class of monofunctional free-radically curable monomers suitable in the practice of the present invention includes one or more N,N-disubstituted (meth)acrylamides. Use of an N,N-disubstituted (meth)acrylamide provides numerous advantages. For example, the use of this kind of monomer provides antistatic coatings which show improved adhesion to polycarbonate substrates. Further, use of this kind of monomer also provides coatings with improved weatherability and toughness. Preferably, the N,N-disubstituted (meth)acrylamide has a molecular weight in the range from 99 to about 500, preferably from about 99 to about 200.

The N,N-disubstituted (meth)acrylamide monomers generally have the formula:

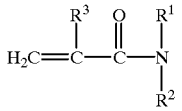

wherein $R^1$ and $R^2$ are each independently hydrogen, a $(C_1–C_8)$alkyl group (linear, branched, or cyclic) optionally having hydroxy, halide, carbonyl, and amido functionalities, a $(C_1–C_8)$alkylene group optionally having carbonyl and amido functionalities, a $(C_1–C_4)$alkoxymethyl group, a $(C_4–C_{10})$aryl group, a $(C_1–C_3)$alk$(C_4–C_{10})$aryl group, or a $(C_4–C^{10})$heteroaryl group; with the proviso that only one of $R^1$ and $R^2$ is hydrogen; and $R^3$ is hydrogen, a halogen, or a methyl group. Preferably, $R^1$ is a $(C_1–C_4)$alkyl group; $R^2$ is a $(C_1–C_4)$alkyl group; and $R^3$ is hydrogen, or a methyl group. $R^1$ and $R^2$ can be the same or different. More preferably, each of $R^1$ and $R^2$ is $CH_3$, and $R^3$ is hydrogen.

Examples of such suitable (meth)acrylamides are N-tert-butylacrylamide, N,N-dimethylacrylamide, N,N-diethylacrylamide, N-(5,5-dimethylhexyl)acrylamide, N-(1,1 -dimethyl-3-oxobutyl)acrylamide, N-(hydroxymethyl)acrylamide, N-(isobutoxymethyl) acrylamide, N-isopropylacrylamide, N-methylacrylamide, N-ethylacrylamide, N-methyl-N-ethylacrylamide, and N,N'-methylene-bis acrylamide. A particularly preferred (meth) acrylamide is N,N-dimethyl (meth)acrylamide.

Other examples of free-radically curable monomers include alkenes such as ethene, 1-propene, 1-butene, 2-butene (cis or trans) compounds including an allyloxy moiety, and the like.

In addition to, or as an alternative to, the monofunctional free-radically curable monomer, any kind of multifunctional free-radically curable monomers preferably having di, tri, and/or tetra free-radically curable functionality also can be used in the present invention. Such multifunctional (meth) acrylate compounds are commercially available from a number of different suppliers. Alternatively, such compounds can be prepared using a variety of well known reaction schemes. For example, according to one approach, a (meth)acrylic acid or acyl halide or the like is reacted with a polyol having at least two, preferably 2 to 4, hydroxyl groups. This approach can be represented by the following schematic reaction scheme which, for purposes of illustration, shows the reaction between acrylic acid and a triol:

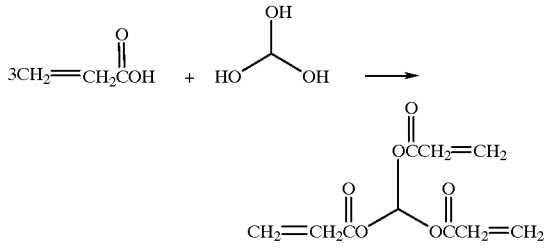

This reaction scheme as illustrated provides a trifunctional acrylate. To obtain di or tetra functional compounds, corresponding diols and tetrols could be used in place of the triol, respectively.

According to another approach, a hydroxy or amine functional (meth)acrylate compound or the like is reacted with a polyisocyanate, or isocyanurate, or the like having 2 to 4 NCO groups or the equivalent. This approach can be represented by the following schematic reaction scheme which, for purposes of illustration, shows the reaction between hydroxyethyl acrylate and a diisocynate:

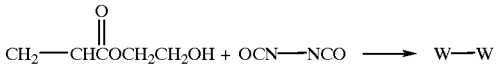

wherein each W is

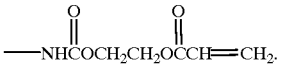

This reaction scheme as illustrated provides a difunctional (meth)acrylate. To obtain tri or tetra functional compounds, corresponding tri or tetra functional isocyanates could be used in place of the diisocyanate, respectively.

Another preferred class of multifunctional (meth)acryl functional compounds includes one or more multifunctional, ethylenically unsaturated esters of (meth)acrylic acid and may be represented by the following formula:

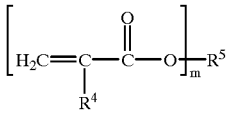

wherein $R^4$ hydrogen, halogen or a $(C_1–C_4)$alkyl group; $R^5$ is a polyvalent organic group having m valencies and can be cyclic, branched, or linear, aliphatic, aromatic, or heterocyclic, having carbon, hydrogen, nitrogen, nonperoxidic oxygen, sulfur, or phosphorus atoms; and m is an integer designating the number of acrylic or methacrylic groups in the ester and has a value of 2 to 4. Preferably, $R^4$ is hydrogen, methyl, or ethyl, $R^5$ has a molecular weight of about 14–100, and m has a value of 2–4. Where a mixture of multifunctional acrylates and/or methacrylates are used, m preferably has an average value of about 1.05 to 3.

Specific examples of suitable multifunctional ethylenically unsaturated esters of (meth)acrylic acid are the polyacrylic acid or polymethacrylic acid esters of polyhydric alcohols including, for example, the diacrylic acid and dimethylacrylic acid ester of aliphatic diols such as ethyleneglycol, triethyleneglycol, 2,2-dimethyl-1,3-propanediol, 1,3-cyclopentanediol, 1-ethoxy-2,3-propanediol, 2-methyl-2,4-pentanediol, 1,4-cyclohexanediol, 1,6-hexanediol, 1,2-cyclohexanediol, 1,6-cyclohexanedimethanol; hexafluorodecanediol, octafluorohexanediol, perfluoropolyetherdiol, the triacrylic acid and trimethacrylic acid esters of aliphatic triols such as glycerin, 1,2,3-propanetrimethanol, 1,2,4-butanetriol, 1,2,5-pentanetriol, 1,3,6-hexanetriol, and 1,5,10-decanetriol; the triacrylic acid and trimethacrylic acid esters of tris (hydroxyethyl) isocyanurate; the tetraacrylic and tetramethacrylic acid esters of aliphatic triols, such as 1,2,3,4-butanetetrol, 1,1,2,2,-tetramethylolethane, and 1,1,3,3-tetramethylolpropane; the diacrylic acid and dirnethacrylic acid esters of aromatic diols such as pyrocatechol, and bisphenol A; mixtures thereof, and the like.

Still referring to FIGS. 1*a*, 1*b*, 1*c* and 2, gas 16 may be any gas or combination of gases that may be inert or reactive with respect to all or a portion of liquid composition 12, as desired. However, in many applications it is preferred that gas 16 is inert with respect to all components of liquid composition 12. In particular, when liquid composition 12 includes an organic liquid, it is preferable that gas 16 does not include an oxidizing gas such as oxygen. Representative examples of inert gases include nitrogen, helium, argon, carbon dioxide, combinations of these, and the like. For liquid compositions 12 in which oxidation is not a concern, ordinary ambient air could be used as gas 16 if desired.

Figure 5A:
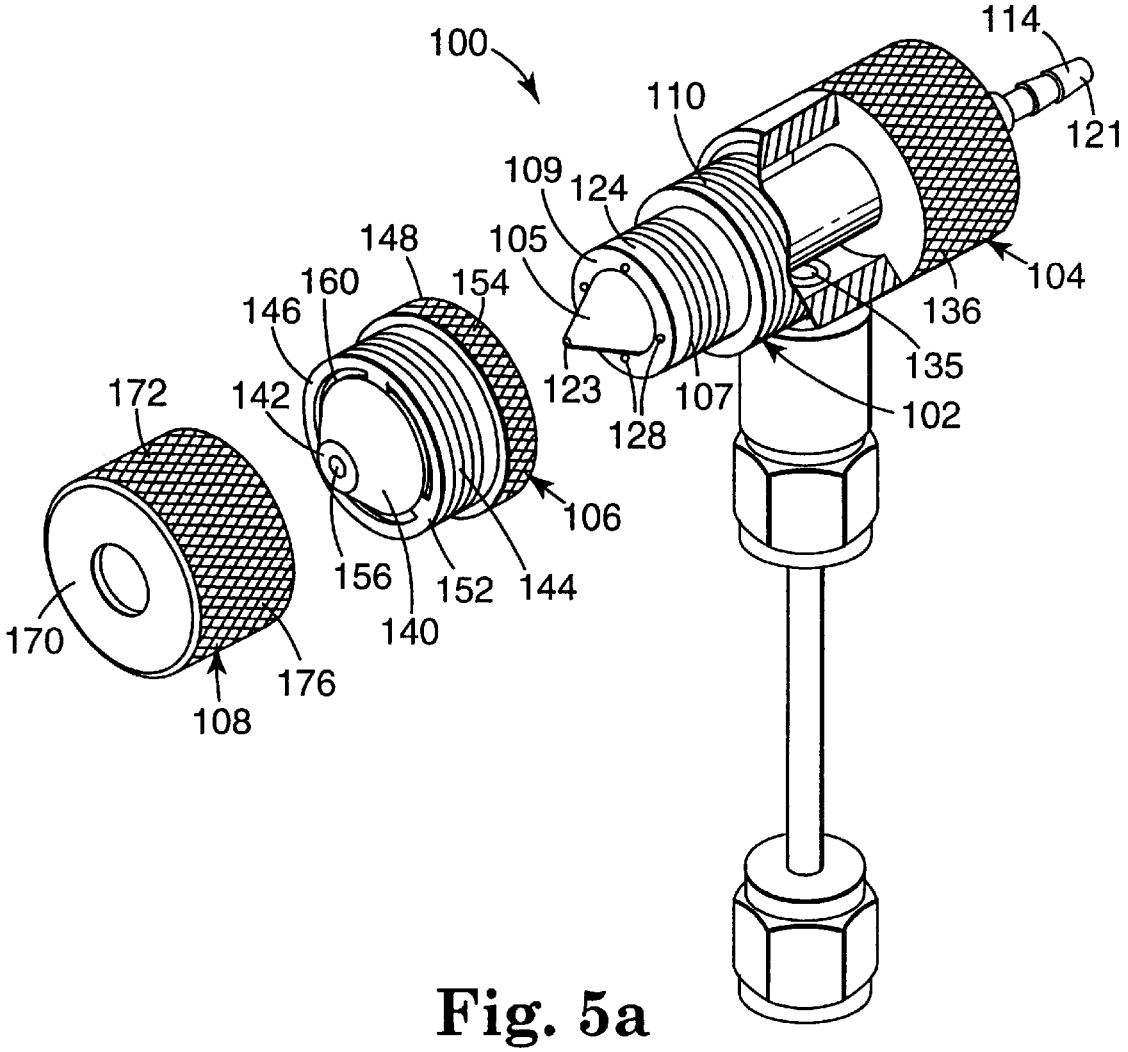
FIG. 5*a* is an exploded perspective view of a preferred apparatus embodiment of the present invention for achieving atomization and vaporization of a liquid.
Figure 5B:
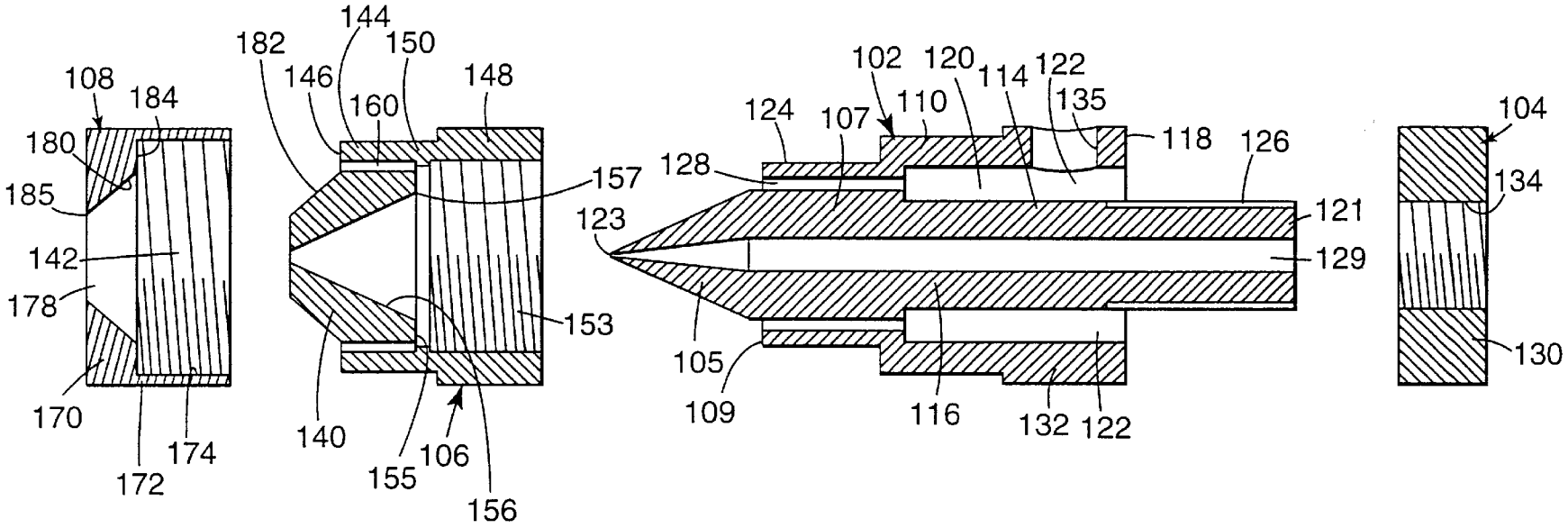
FIG. 5*b* is a side view, shown in cross section, of the exploded apparatus view of FIG. 5*a;*
Figure 5C:
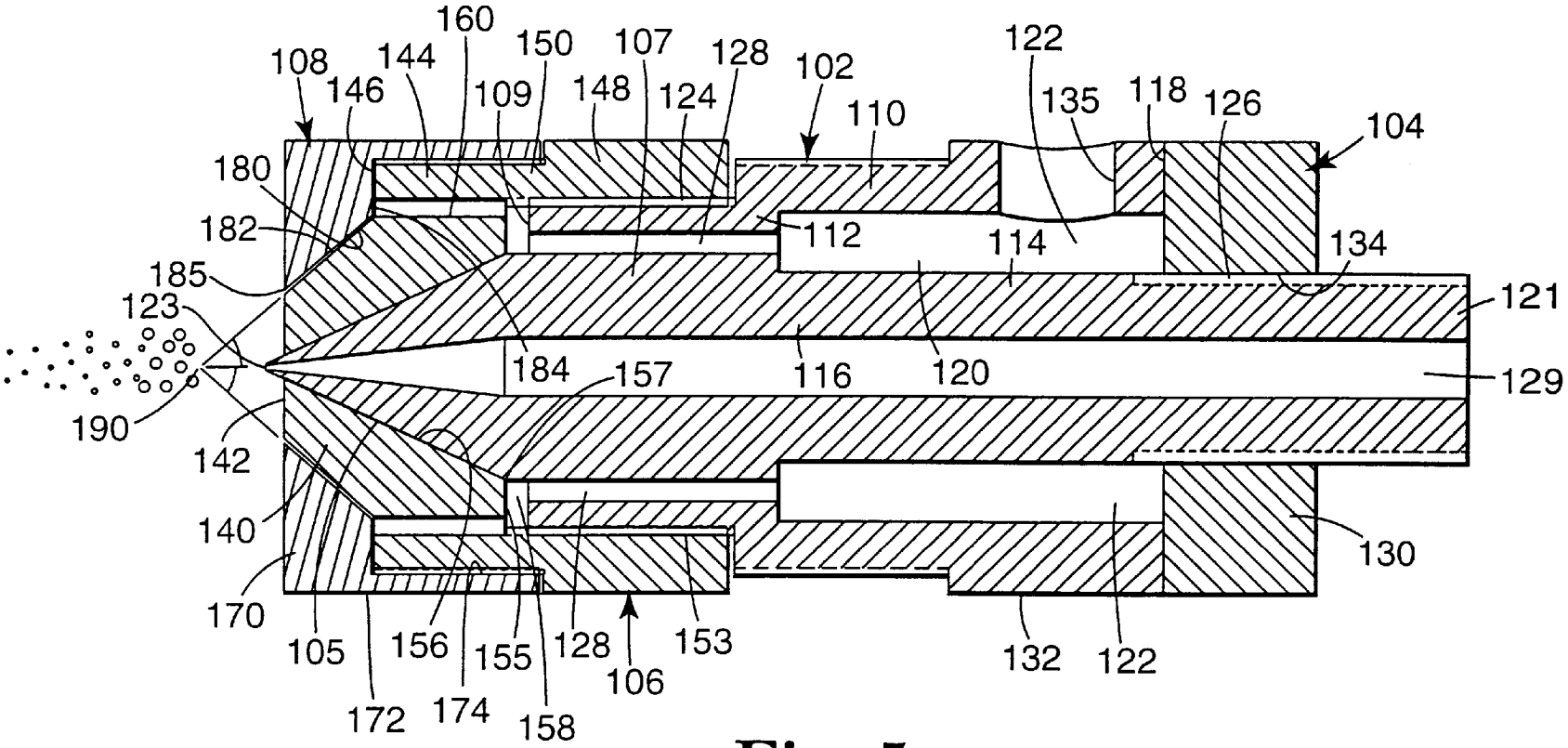

FIGS. 5*a*, 5*b*, and 5*c* show one embodiment of a particularly preferred apparatus 100 incorporating the principles of the present invention discussed above. Apparatus 100 includes, as main components, main barrel 102, end cap 104, adapter 106, and outlet cover 108. These main components are adapted to be assembled using threadable engagement, making it easy to disassemble and reassemble apparatus 100 as needed for maintenance and inspection.

Main barrel 102 includes conical head 105 coupled to cylindrical body 107 in such a manner as to provide shoulder face 109. At the other end of body 107, outer cylindrical wall 110 extends longitudinally from an outer periphery 132 of body 107. Inner cylindrical wall 114 extends longitudinally from an interior portion 116 of body 107. The length of inner cylindrical wall 114 is greater than that of outer cylindrical wall 110 so that end cap 104 can be threadably engaged over inner cylindrical wall 114 to sealingly engage outer cylindrical wall 110 at juncture 118. Inner cylindrical wall 114 and outer cylindrical wall 110 are spaced apart from each other so as to define gap 120 which forms a part of annular chamber 122 (see FIG. 5*c*) when main barrel 102 and end cap 104 are assembled with body 107. The outer surface 124 of body 107 is threaded and sized for threadable engagement with adapter 106. The outer surface 126 of inner cylindrical wall 114 is also threaded and sized for threadable engagement with end cap 104.

At least one through aperture 128 is provided in body 107 in order to provide fluid communication between gap 120, and hence annular chamber 122, and shoulder face 109. In the preferred embodiment shown, four apertures 128 are provided and are spaced equidistantly around shoulder face 109. Main barrel 102 further includes a through aperture 129 extending longitudinally along the axis of main barrel 102 from inlet end 121 positioned on inner cylindrical wall 114 to discharge end 123 positioned on conical head 105. Through aperture 129 is generally cylindrical, but tapers to a reduced diameter at discharge end 123. Preferably, through aperture 129 has sufficient land length and orifice diameters at ends 121 and 123 to achieve laminar flow. In one embodiment, for example, through aperture 129 has a length of 47 mm, a diameter of about 2.5 mm along much of its length, but then tapers to a diameter of 0.25 mm at discharge end 123.

End cap 104 generally includes end wall 130. End wall 130 has a centrally located aperture 134 adapted to fit over and threadably engage inner cylindrical wall 114 of main barrel 102. When end cap 104 and main barrel 102 are assembled by threadable engagement, as shown best in FIG. 5*c*, endwall 130 sealingly engages outer cylindrical wall 110 of main barrel 102 at juncture 118. Endwall 130 thus helps define annular chamber 122 surrounding an initial portion of inner cylindrical wall 114 proximal to inlet end 121. Sidewall 112 includes an aperture 135 that provides a connection between the exterior of apparatus 100 and annular chamber 122 when apparatus 100 is assembled. Outer surface 136 of end cap 104 is knurled to help provide a good grip against end cap 104 during assembly and disassembly of apparatus 100.

Adapter 106 includes conical head 140 with flat end face 142 coupled to body 144 in a manner so as to provide outer shoulder 146. At the other end of body 144, cylindrical wall 148 extends longitudinally from an outer periphery 150 of body 144. Outer surface 152 of body 144 is threaded and sized for threadable engagement with outlet cover 108. Inner surface 153 of cylindrical wall 148 is threaded and sized for threadable engagement with body 107 of main barrel 102. Outer surface 154 of cylindrical wall 148 is knurled to help provide a good grip against adapter 106 during assembly and disassembly of apparatus 100.

Body 144 and conical head 140 are provided with tapered through aperture 156 for receiving conical head 105 of main barrel 102. Inner shoulder 155 spans the distance between edge 157 of through aperture 156 and inner surface 153 of cylindrical wall 148. Conical head 105 is sealingly received in tapered through aperture 156 in a manner such that discharge end 123 of conical head 105 just protrudes from end face 142. Additionally, when conical head 105 is fully inserted into through aperture 156, shoulder face 109 of main barrel 102 is spaced apart from inner shoulder 155, thereby defining secondary annular chamber 158. Body 144 includes a plurality of arcuate through recesses 160 that provide fluid communication between inner shoulder 155 and outer shoulder 146. Arcuate through recesses 160 are connected with through apertures 128 of main barrel 102 via secondary annular chamber 158. Arcuate through recesses 160 distribute the substantially linear, streamlined flow emerging from apertures 128 into a generally annularly-shaped flow pattern emerging from arcuate recesses 160.

Outlet cover 108 includes end portion 170 and sidewall 172. Inner surface 174 of sidewall 172 is threaded and sized for threadable engagement with body 144 of adapter 106. Outer surface 176 of sidewall 172 is knurled to help provide a good grip against the outlet cover during assembly and disassembly of apparatus 100. End portion 170 is provided with inner wall 180 defining tapered through aperture 178 which is adapted to receive tapered head 140 of adapter 106 in a gapped manner so as to define conical passageway 182 extending between inner wall 180 and tapered head 140. Passageway 182 thus has an inlet 184 proximal to arcuate through recesses 160 and an outlet 185 proximal to end face 142. Outlet 185 is annularly-shaped and surrounds discharge end 123 of through aperture 129.

In a preferred mode of operation of apparatus 100, a supply of liquid material enters inlet end 121 of through passage 129 and then flows to discharge end 123 where a stream of the liquid material is ejected along the longitudinal axis of apparatus 100 toward collision point 190, preferably in a laminar state. In the meantime, a supply of a gas enters annular chamber 122 through aperture 135. The flow of carrier gas is then constricted and accelerated as the gas flows from annular chamber 122 to secondary annular chamber 158 through apertures 128. From secondary annular chamber 158, the flow of gas enters arcuate passageways 160, whereby the constricted flow from apertures 128 is redistributed to form a substantially annularly-shaped flow. From arcuate passageways 160, the flow of carrier gas is again restricted in tapered passageway 182 and then is ejected as a conically-shaped, hollow stream toward the collision point 190. At collision point 190, the stream of gas implosively and convergingly collides with the stream of liquid material, thereby atomizing and vaporizing the liquid material.

Figure 6:
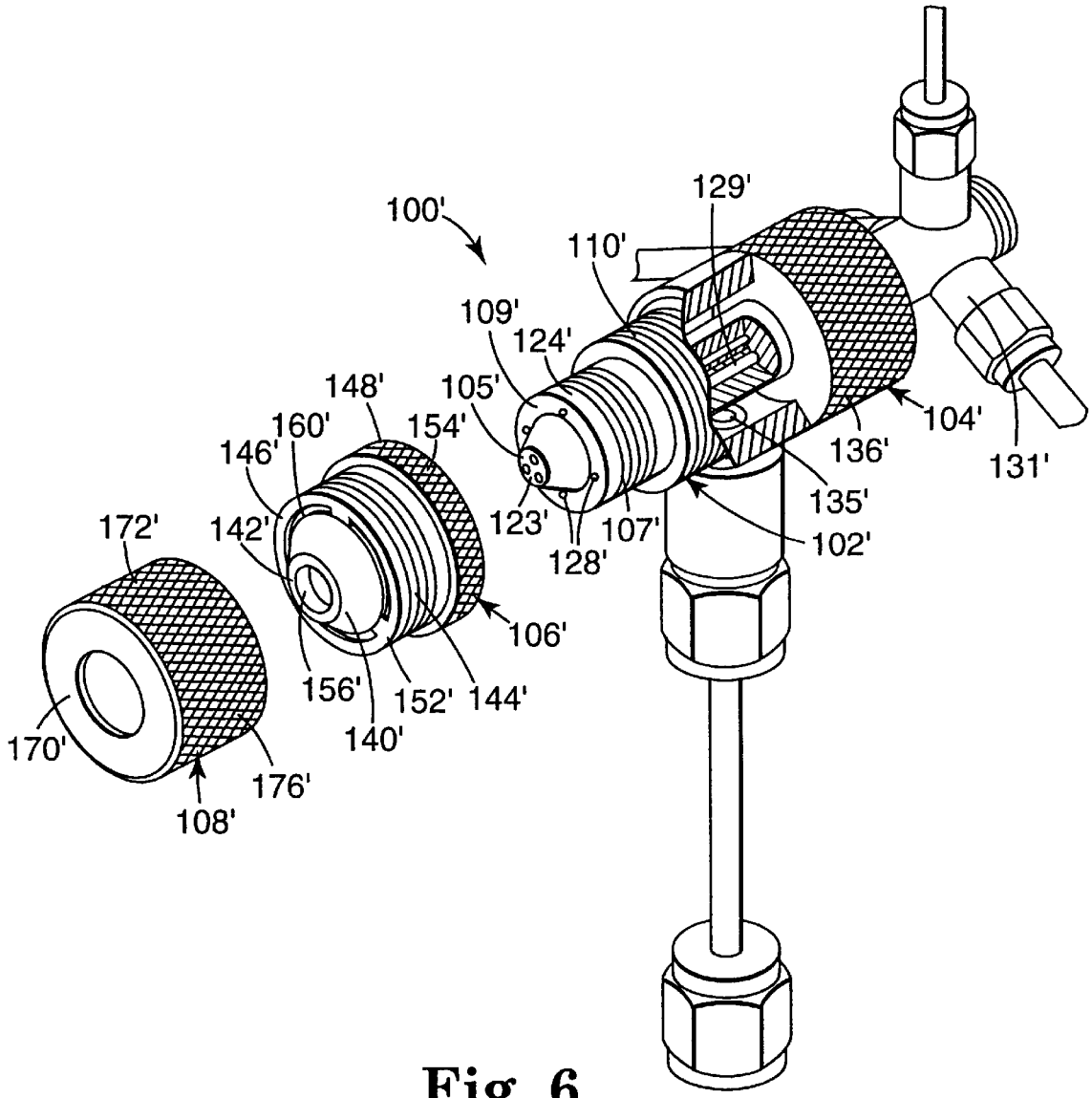
* and FIG. 6 is an exploded perspective view, with parts broken away for purposes of illustration, of an alternative preferred apparatus embodiment of the present invention suitable for simultaneously handling multiple liquid compositions.

In some applications, it may be desirable to generate a homogeneous vapor from two or more liquid compositions that are sufficiently incompatible with each other so that use of apparatus 100 may not be optimal for forming homogenous, atomized and/or vaporized blends of such components. The use of apparatus 100 may be less than optimal, for instance, if the liquid materials to be processed include two or more immiscible components that cannot be caused to flow through apparatus 10 in homogeneous fashion. Alternatively, the use of apparatus 100 may be less than optimal in instances in which the liquid materials include two or more components that are so reactive with each other in the liquid state that transporting such materials through apparatus 100 in a single stream could cause apparatus 100 to plug up. In such circumstances, FIG. 6 shows a particularly preferred embodiment of a apparatus 100' of the present invention that is especially useful for forming homogeneous atomized and/or vaporized blends from a plurality of liquid streams. Apparatus 100' is generally identical to apparatus 10, except that main barrel 102 includes not just one through aperture 129 but a plurality of through apertures 129' for handling multiple fluid streams at the same time. For purposes of illustration, three through apertures 129' are shown, but a greater or lesser number could be used depending upon how many fluid streams are to be handled. For instance, in other embodiments, main barrel 102' might include from 2 to 5 of such through apertures 129'. Apparatus 100' also includes piping 131' in order to supply respective fluid stream for each such through aperture 129'. Apparatus 100' is thus able to provide substantially simultaneous, implosive, energetic atomization and vaporization of multiple fluid streams. This approach provides a vapor with substantially better homogeneity than if one were to attempt to generate and then mix multiple vapors from multiple devices.

Other embodiments of this invention will be apparent to those skilled in the art upon consideration of this specification or from practice of the invention disclosed herein. Various omissions, modifications, and changes to the principles and embodiments described herein may be made by one skilled in the art without departing from the true scope and spirit of the invention which is indicated by the following claims.

What is claimed is:

1. An apparatus suitable for atomizing and vaporizing at least a first liquid by colliding at least one gas with the first liquid, said apparatus comprising:

(a) a gas inlet through which the gas enters the apparatus;

(b) at least one liquid inlet separate from the gas inlet through which the first liquid enters the apparatus;

(c) a discharge end, comprising:

(i) at least one first liquid discharge outlet through which at least one stream of the first liquid is discharged from the apparatus;

(ii) at least one gas discharge outlet through which at least one stream of gas is discharged from the apparatus to collide with and thereby atomize the discharged stream of the first liquid;

(d) a first liquid passageway interconnecting the first liquid inlet with the first liquid discharge outlet; and (e) a gas passageway separate from the first liquid passageway and interconnecting the gas inlet with the at least one gas discharge outlet, said gas passageway comprising:

at least one preheating chamber located so that heat can be transferred from gas in the chamber to preheat the first liquid in the initial portion of the first liquid passageway; and constricted passages downstream of the preheating chamber which have substantially smaller cross-sectional area, normal to the direction of gas flow, than the preheating chamber and therefore increase the velocity of gas flowing through the gas passageway.

2. The apparatus of claim 1, wherein the at least one preheating chamber is annularly-shaped and surrounds the initial portion of the at least one liquid passageway.

3. The apparatus of claim 2, wherein the preheating chamber and the liquid passageway share a common wall through which heat can be transferred from the gas to the first liquid.

4. The apparatus of claim 1 in which the portion of the gas passageway near the gas discharge orifice is the only outlet for gas flowing through the gas passageway and comprises at least 6 holes sized, oriented and arranged to yield a plurality of gas streams which converge in a conical shape.

5. The apparatus of claim 1, wherein the portion of the gas passageway proximal to the annularly-shaped gas discharge orifice is the only outlet for gas flowing through the gas passageway and is in the shape of a converging annulus, whereby the gas stream ejected through the frustoconical shaped gas discharge orifice is a converging annular flow of gas.

6. The apparatus of claim 1, wherein a portion of the gas passageway downstream from the gas preheating chamber and upstream from the gas discharge outlet comprises an annular pressure dampening chamber surrounding the first liquid passageway and comprising at least one gas inlet port and at least one gas outlet port, wherein the at least one gas inlet port is radially offset from the at least one gas outlet port.

7. The apparatus of claim 6, wherein the pressure dampening chamber has a plurality of gas entry ports and a plurality of gas exit ports, said gas entry ports being positioned proximal to the inner periphery of the dampening chamber and said gas exit ports being positioned proximal to the outer periphery of the dampening chamber.

8. An apparatus suitable for atomizing and vaporizing a plurality of liquids by colliding at least one gas with the liquids, said apparatus comprising:

(a) a gas inlet through which the gas enters the apparatus, (b) a plurality of liquid inlets through which each liquid enters the apparatus;

(c) a discharge end, comprising:

(i) a plurality of liquid discharge outlets through which corresponding streams of liquid are discharged from the apparatus; and (ii) at least one gas discharge outlet through which at least one stream of gas is discharged from the apparatus to convergingly and implosively collide with and thereby atomize the streams of discharged liquid;

(d) a plurality of liquid passageways interconnecting at least one of the liquid inlets with corresponding liquid discharge outlets; and (e) a gas passageway interconnecting the gas inlet with the at least one gas discharge outlet, wherein the gas discharge outlet comprises at least one orifice surrounding the liquid discharge outlets; and the gas passageway comprises: at least one preheating chamber located to transfer heat from gas in the preheating chamber to liquid in the initial portion of the liquid passageways; and constricted passages downstream of the preheating chamber which have substantially smaller cross-sectional area, normal to the direction of gas flow, than the preheating chamber and therefore increase the velocity of gas flowing through the gas passageway.

9. The apparatus of claim 8, wherein the gas discharge outlet has a frustoconical shape converging toward the discharge end of the apparatus.

10. A method of atomizing and vaporizing at least one liquid through a collision with a heated gas, comprising the steps of:

(a) causing heat to transfer from a flow of the heated gas to flow through a gas passageway and to preheat at least one liquid;

(b) after step (a), accelerating the flow of heated gas;

(c) after step (b) shaping the accelerated heated gas flow into at least one converging heated gas stream that convergingly surrounds the preheated liquid flow; and (d) causing the converging heated gas stream to convergingly and implosively collide with the preheated liquid stream, whereby the liquid stream is atomized and vaporized.

11. The method of claim 10, wherein the preheated liquid stream is laminar just prior to the collision with the heated gas.

12. The method of claim 10, wherein, at the time of collision, the liquid has a velocity in the range from 0.1 m/s to 30 m/s and the gas has a velocity in the range from 40 m/s to 350 m/s.

13. The method of claim 10, wherein the ratio of the gas velocity to the liquid velocity at the time of collision is at least 20:1.

14. The method of claim 13, wherein the ratio of the gas velocity to the liquid velocity at the time of collision is in the range from $10^3$:1 to $10^6$:1.

15. The method of claim 10, wherein step (d) comprises causing the heated gas to flow through a frustoconical shaped passage that surrounds a passageway through which the liquid stream flows.

16. The method of claim 10, wherein step (c) includes conveying the gas through a pressure dampening chamber constituting a portion of the gas passageway such that the gas enters and exits the pressure dampening chamber through radially offset entry and exit ports.

17. The method of claim 10 in which the converging heated gas stream or streams of steps (c) and (d) are the only means by which the flow of gas reaches the liquid stream.

18. The method of claim 10 in which at least one liquid is selected from the group consisting of monomers, oligomers, and polymers.

* * * * *

UNITED STATES PATENT AND TRADEMARK OFFICE

CERTIFICATE OF CORRECTION

PATENT NO. : 6,012,647
DATED : January 11, 2000
INVENTOR(S) : Ruta et al.

It is certified that error appears in the above-identified patent and that said Letters Patent is hereby corrected as shown below:

Column 7,
Line 43, after "constricted" delete -- a --.

Column 10,
Line 43, "organofanctional" should read -- organofunctional --.
Line 47, "acryloxyallyl" should read -- acryloxyalkyl --.
Line 49, "acryloxyallyl" should read -- acryloxyalkyl --.

Column 11,
Line 56, "allylated" should read -- alkylated --.

Column 13,
Line 14, "$(C_4\text{-}C^{10})$" should read -- $(C_4\text{-}C_{10})$ --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*